US010823463B2

(12) United States Patent
Liu et al.

(10) Patent No.: US 10,823,463 B2
(45) Date of Patent: Nov. 3, 2020

(54) EJECTOR HEAT PUMP

(71) Applicant: Carrier Corporation, Jupiter, FL (US)

(72) Inventors: Hongsheng Liu, Shanghai (CN); Parmesh Verma, South Windsor, CT (US); Thomas D. Radcliff, Vernon, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 125 days.

(21) Appl. No.: 15/736,586

(22) PCT Filed: Jun. 16, 2016

(86) PCT No.: PCT/US2016/037822
§ 371 (c)(1),
(2) Date: Dec. 14, 2017

(87) PCT Pub. No.: WO2017/007585
PCT Pub. Date: Jan. 12, 2017

(65) Prior Publication Data

US 2018/0187929 A1 Jul. 5, 2018

(30) Foreign Application Priority Data

Jul. 3, 2015 (CN) ..... 2015 1 0383148

(51) Int. Cl.
*F25B 13/00* (2006.01)
*F25B 41/00* (2006.01)
(Continued)

(52) U.S. Cl.
CPC ..... *F25B 13/00* (2013.01); *F04F 5/46* (2013.01); *F25B 9/002* (2013.01); *F25B 9/08* (2013.01);
(Continued)

(58) Field of Classification Search
CPC .. F25B 13/00; F25B 9/002; F25B 9/08; F25B 2341/0012; F25B 2341/0015; F25B 2400/0407; F25B 41/04
See application file for complete search history.

(56) References Cited

U.S. PATENT DOCUMENTS 1,836,318 A 12/1931 Gay
3,031,977 A 5/1962 Elliot
(Continued)

FOREIGN PATENT DOCUMENTS

CN 201047685 Y 4/2008
CN 102235782 A 11/2011
(Continued)

OTHER PUBLICATIONS

Machine translation of JP2010151424 (Year: 2010).*
(Continued)

*Primary Examiner* — Joseph F Trpisovsky
(74) *Attorney, Agent, or Firm* — Bachman & LaPointe, P.C.

(57) ABSTRACT

A vapor compression system (200; 400; 600; 700; 800; 900; 1000) comprises a plurality of valves (260, 262, 264; 260) controllable to define a first mode flowpath and a second mode flowpath. The first mode flowpath is sequentially through: a compressor (22); a first heat exchanger (30); a first nozzle (228; 624); and a separator (48), and then branching into: a first branch returning to the compressor; and a second branch passing through an expansion device (70) and a second heat exchanger (64) to the rejoin the flowpath between the first heat exchanger and the separator. The second mode flowpath is sequentially through: the compressor; the second heat exchanger; a second nozzle (248; 625); and the separator, and then branching into: a first branch returning to the compressor; and a second branch passing through the expansion device and first heat
(Continued)

exchanger to the rejoin the flowpath between the first heat exchanger and the separator.

9 Claims, 11 Drawing Sheets

(51) Int. Cl.

| | |
|---|---|
| ***F25B 41/04*** | (2006.01) |
| ***F04F 5/46*** | (2006.01) |
| ***F25B 9/00*** | (2006.01) |
| ***F25B 9/08*** | (2006.01) |

(52) U.S. Cl.
CPC ..... *F25B 41/00* (2013.01); *F25B 41/04* (2013.01); *F25B 2341/0012* (2013.01); *F25B 2341/0015* (2013.01); *F25B 2400/0407* (2013.01); *F25B 2400/23* (2013.01)

(56) References Cited

U.S. PATENT DOCUMENTS

| | | | | |
|---|---|---|---|---|
| 3,277,660 | A | 10/1966 | Kemper et al. | |
| 4,321,801 | A | 3/1982 | Collard, Jr. | |
| 4,342,200 | A | 8/1982 | Lowi, Jr. | |
| 4,563,840 | A | 1/1986 | Urakami | |
| 6,550,265 | B2 | 4/2003 | Takeuchi et al. | |
| 6,729,157 | B2 | 5/2004 | Oshitani et al. | |
| 6,945,074 | B2 | 9/2005 | Sato et al. | |
| 7,779,647 | B2 | 8/2010 | Takeuchi et al. | |
| 8,104,308 | B2 | 1/2012 | Ikegami et al. | |
| 8,528,354 | B2 | 9/2013 | Esaki | |
| 8,783,060 | B2 | 7/2014 | Nishijima et al. | |
| 9,494,347 | B2 | 11/2016 | Kayano et al. | |
| 2011/0005268 | A1 | 1/2011 | Oshitani et al. | |
| 2012/0234026 | A1* | 9/2012 | Oh | F25B 9/008 62/115 |
| 2013/0111935 | A1 | 5/2013 | Zou et al. | |
| 2013/0111944 | A1 | 5/2013 | Wang et al. | |
| 2013/0277448 | A1* | 10/2013 | Liu | F04F 5/461 239/11 |
| 2014/0096557 | A1 | 4/2014 | Higashiiue | |
| 2015/0308462 | A1 | 10/2015 | Awa et al. | |
| 2017/0003040 | A1* | 1/2017 | Chaudhry | F25B 13/00 |

FOREIGN PATENT DOCUMENTS

| | | | |
|---|---|---|---|
| CN | 103003641 | A | 3/2013 |
| CN | 103003645 | A | 3/2013 |
| CN | 204115293 | U | 1/2015 |
| CN | 204299974 | U | 4/2015 |
| EP | 0704663 | A1 | 4/1996 |
| JP | 2005037114 | A | 2/2005 |
| JP | 2005300067 | A | 10/2005 |
| JP | 2009109064 | A | 5/2009 |
| JP | 2009222362 | A | 10/2009 |
| JP | 2010133584 | A | 6/2010 |
| JP | 2010151424 | A | 7/2010 |
| JP | 2014190580 | A | 10/2014 |
| WO | 2014010178 | A1 | 1/2014 |
| WO | 2014076903 | A1 | 5/2014 |

OTHER PUBLICATIONS

International Search Report and Written Opinion dated Jan. 3, 2017 for PCT/US2016/037822.

Zine Aidoun, et al., "Ejector Applications in Refrigeration and Heating: An Overview of Modeling, Operation and Recent Developments", conference paper, Proceedings of the 10th Int'l Heat Pump Conference, Sep. 22, 2011, International Energy Agency Heat Pump Centre, Tokyo Japan.

U.S. Office Action dated Jul. 25, 2018 for U.S. Appl. No. 15/592,768.

U.S. Office Action dated Feb. 19, 2019 for U.S. Appl. No. 15/592,768.

Chinese Office Action dated Nov. 26, 2019 for Chinese Patent Application No. 201510383148.2.

* cited by examiner

EJECTOR HEAT PUMP

BACKGROUND

The present disclosure relates to refrigeration. More particularly, it relates to ejector refrigeration systems.

Earlier proposals for ejector refrigeration systems are found in U.S. Pat. Nos. 1,836,318 and 3,277,660. An ejector heat pump system is disclosed in CN204115293U.

FIG. 1 shows one basic example of an ejector refrigeration system (vapor compression system) 20. The system includes a compressor 22 having an inlet (suction port) 24 and an outlet (discharge port) 26. The compressor and other system components are positioned along a refrigerant circuit or flowpath 27 and connected via various conduits (lines). Exemplary refrigerant is carbon dioxide ($CO_2$)-based (e.g., at least 50% by weight). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary flow inlet (liquid or supercritical or two-phase inlet) 40 of an ejector 38. The ejector 38 also has a secondary flow inlet (saturated or superheated vapor or two-phase inlet) 42 and an outlet 44. A line 46 extends from the ejector outlet 44 to an inlet 50 of a separator 48. The separator has a liquid outlet 52 and a gas or vapor outlet 54. A suction line 56 extends from the gas outlet 54 to the compressor suction port 24. The lines 28, 36, 46, 56, and components therebetween define a primary loop 60 of the refrigerant circuit 27.

From the separator, the flowpath branches into a first branch 61 completing the primary loop 60 to return to the compressor and a second branch 63 forming a portion of a secondary loop 62. The secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62. An expansion device 70 is positioned in a line 72 which extends between the separator liquid outlet 52 and the evaporator inlet 66. An ejector secondary inlet line 74 extends from the evaporator outlet 68 to the ejector secondary flow inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary flow inlet 40 via the line 36.

An exemplary implementation is a chiller wherein the evaporator 64 is a refrigerant-water heat exchanger having a refrigerant flowpath leg 80 in heat exchange relation with a water flowpath leg 82 carrying a flow of water 84 between an inlet 86 and an outlet 88. In the normal cooling mode, refrigerant along the leg 80 absorbs heat from water along the leg 82.

The exemplary ejector 38 (FIG. 2) is formed as the combination of a motive (primary) nozzle 100 nested within an outer member 102. The primary flow inlet 40 is the inlet to the motive nozzle 100. The outlet 44 is the outlet of the outer member 102. The primary refrigerant flow 103 enters the inlet 40 and then passes into a convergent section 104 of the motive nozzle 100. It then passes through a throat section 106 and an expansion (divergent) section 108 through an outlet (exit) 110 of the motive nozzle 100. The motive nozzle

100 accelerates the flow 103 and decreases the pressure of the flow. The secondary flow inlet 42 forms an inlet of the outer member 102. The pressure reduction caused to the primary flow by the motive nozzle helps draw the secondary flow 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. Thus, respective primary and secondary flowpaths extend from the primary flow inlet and secondary flow inlet to the outlet, merging at the exit. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary flow inlet 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability). The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (e.g., temperature sensors and pressure sensors at various locations). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

SUMMARY

One aspect of the disclosure involves a vapor compression system comprising a plurality of valves controllable to define a first mode flowpath and a second mode flowpath. The first mode flowpath is sequentially through: a compressor; a first heat exchanger; a first nozzle; and a separator, and then branching into: a first branch returning to the compressor; and a second branch passing through an expansion device and a second heat exchanger to the rejoin the flowpath between the first heat exchanger and the separator. The second mode flowpath is sequentially through: the compressor; the second heat exchanger; a second nozzle; and the separator, and then branching into: a first branch returning to the compressor; and a second branch passing through the expansion device and first heat exchanger to the rejoin the flowpath between the first heat exchanger and the separator.

Another aspect of the disclosure involves a vapor compression system comprising: a compressor; a first heat exchanger; a second heat exchanger; and a separator having: an inlet; a liquid outlet; and a vapor outlet; an expansion device; and a plurality of conduits. The system further comprises a plurality of valves controllable to define a first mode flowpath and a second mode flowpath. The first mode flowpath is sequentially through: the compressor; the first heat exchanger; a first nozzle; and the separator, and then branching into a first branch returning to the compressor and a second branch passing through the expansion device and second heat exchanger to the rejoin the flowpath between the first heat exchanger and the separator. The second mode flowpath is sequentially through: the compressor; the second heat exchanger; a second nozzle; and the separator, and then branching into a first branch returning to the compressor and a second branch passing through the expansion device and first heat exchanger to the rejoin the flowpath between the first heat exchanger and the separator.

In one or more embodiments of any of the foregoing embodiments, the first nozzle is a motive nozzle of a first ejector and the second nozzle is a motive nozzle of a second ejector.

In one or more embodiments of any of the foregoing embodiments, one or more check valves are positioned to block reverse flow through at least one of the first ejector and second ejector.

Another aspect of the disclosure involves a vapor compression system having: a compressor; a first heat exchanger; a second heat exchanger; a first ejector; a separator; an expansion device; and a plurality of conduits. The first ejector comprises: a motive flow inlet; a secondary flow inlet; and an outlet. The separator has: an inlet; a liquid outlet; and a vapor outlet. The system further includes a second ejector comprising: a motive flow inlet; a secondary flow inlet; and an outlet. The system further includes a plurality of valves controllable to define a first mode flowpath and a second mode flowpath. The first mode flowpath is sequentially through: the compressor; the first heat exchanger; the first ejector from the first ejector motive flow inlet through the first ejector outlet; and the separator, and then branching into a first branch returning to the compressor and a second branch passing through the expansion device and second heat exchanger to the first ejector secondary flow inlet. The second mode flowpath is sequentially through: the compressor; the second heat exchanger; the second ejector from the second ejector motive flow inlet through the second ejector outlet; and the separator, and then branching into a first branch returning to the compressor and a second branch passing through the expansion device and first heat exchanger to the second ejector secondary flow inlet.

Another aspect of the disclosure involves a vapor compression system comprising: a compressor; a first heat exchanger; a second heat exchanger; at least one ejector; a separator having: an inlet; a liquid outlet; and a vapor outlet; an expansion device; and a plurality of conduits. The system further comprises a plurality of valves controllable to define a first mode flowpath and a second mode flowpath. The first mode flowpath is sequentially through: the compressor; the first heat exchanger; and the separator, and then branching into a first branch returning to the compressor and a second branch passing through the expansion device and second heat exchanger to the rejoin the flowpath between the first heat exchanger and the separator. The second mode flowpath is sequentially through: the compressor; the second heat exchanger in the same direction to flow in the first mode; and the separator, and then branching into a first branch returning to the compressor and a second branch passing through the expansion device and first heat exchanger in the same direction to flow in the first mode to the rejoin the flowpath between the first heat exchanger and the separator.

In one or more embodiments of any of the foregoing embodiments, the plurality of valves comprises a valve positioned to selectively allow flow to the first ejector secondary flow inlet and the second ejector secondary flow inlet.

In one or more embodiments of any of the foregoing embodiments, the valve is configured allow flow to at most one of the first ejector secondary flow inlet and the second ejector secondary flow inlet.

In one or more embodiments of any of the foregoing embodiments, the first ejector and the second ejector are of different sizes.

In one or more embodiments of any of the foregoing embodiments, the first ejector has a greater throat cross-sectional than the second ejector.

In one or more embodiments of any of the foregoing embodiments, the first ejector has a greater mixer cross-sectional area than the second ejector.

In one or more embodiments of any of the foregoing embodiments, the first heat exchanger is a refrigerant-air heat exchanger and the second heat exchanger is a refrigerant-water heat exchanger.

In one or more embodiments of any of the foregoing embodiments, the plurality of valves comprises a first four way valve and a second four way valve.

Another aspect of the disclosure involves a method for operating a vapor compression system comprising: a compressor; a first heat exchanger; a second heat exchanger; at least one ejector; a separator having: an inlet; a liquid outlet; and a vapor outlet; and an expansion device. The method comprises, in a first mode, compressing refrigerant with the compressor to drive the refrigerant along a first mode flowpath sequentially through: the compressor; the first heat exchanger; and the separator, and then branching into a first branch returning to the compressor and a second branch passing through the expansion device and second heat exchanger to the rejoin the flowpath between the first heat exchanger and the separator. The method further comprises, in a second mode, compressing refrigerant with the compressor to drive the refrigerant along a second mode flowpath sequentially through: the compressor; the second heat exchanger in the same direction to flow in the first mode; and the separator, and then branching into a first branch returning to the compressor and a second branch passing through the expansion device and first heat exchanger in the same direction to flow in the first mode to the rejoin the flowpath between the first heat exchanger and the separator.

In one or more embodiments of any of the foregoing embodiments, aspects may be as described herein for the systems.

Another aspect of the disclosure involves an ejector comprising: a first inlet; a second inlet; an outlet; a first flowpath from the first inlet to the outlet; a second flowpath from the second inlet to the outlet; and a first nozzle along the first flowpath. The first flowpath and second flowpath merge downstream of the first nozzle. A second nozzle is along the second flowpath, the first flowpath and second flowpath merging downstream of the second nozzle.

In one or more embodiments of any of the foregoing embodiments, the outlet comprises a first outlet and a second outlet; the first flowpath is from the first inlet to the first outlet; and the second flowpath is from the second inlet to the second outlet.

In one or more embodiments of any of the foregoing embodiments, the first flowpath and second flowpath merge in a plenum.

In one or more embodiments of any of the foregoing embodiments, the ejector further comprises a first mixer and diffuser unit along the first flowpath and a second mixer and diffuser unit along the second flowpath.

In one or more embodiments of any of the foregoing embodiments, the first nozzle and the second nozzle each have a central motive flow passageway and the ejector further comprises at least one actuator for selectively opening and closing a bypass of the central passageway of the first nozzle and the second nozzle.

In one or more embodiments of any of the foregoing embodiments, the actuator comprises a first actuator coupled to the first nozzle and a second actuator coupled to the second nozzle.

In one or more embodiments of any of the foregoing embodiments, a vapor compression system comprises the ejector.

In one or more embodiments of any of the foregoing embodiments, the vapor compression system further comprises: a compressor; a first heat exchanger; a second heat exchanger; and a separator having: an inlet; a liquid outlet; and a vapor outlet; an expansion device.

In one or more embodiments of any of the foregoing embodiments, the vapor compression system further comprises a plurality of conduits and at least one valve positioned to define a first mode flowpath and a second mode flowpath. The first mode flowpath is sequentially through: the compressor; the first heat exchanger; the ejector from the first inlet through the ejector outlet; and the separator, and then branching into a first branch returning to the compressor and a second branch passing through the expansion device and second heat exchanger to the second inlet. The second mode flowpath is sequentially through: the compressor; the second heat exchanger; the ejector from the second inlet through the ejector outlet; and the separator, and then branching into a first branch returning to the compressor and a second branch passing through the expansion device and first heat exchanger to the first inlet.

In one or more embodiments of any of the foregoing embodiments, the first heat exchanger is a refrigerant-air heat exchanger; and the second heat exchanger is a refrigerant-water heat exchanger.

In one or more embodiments of any of the foregoing embodiments, a method for using the ejector comprises: in a first mode, passing a first flow to the first inlet and a second flow to the second inlet, the second flow having a lower pressure at the second inlet than the first flow at the first inlet; and in a second mode, passing a first flow to the first inlet and a second flow to the second inlet, the second flow having a greater pressure at the second inlet than the first flow at the first inlet.

In one or more embodiments of any of the foregoing embodiments: in the first mode, the first flow is a motive flow and the second flow is a secondary flow; and in the second mode, the first flow is a secondary flow and the second flow is a motive flow.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
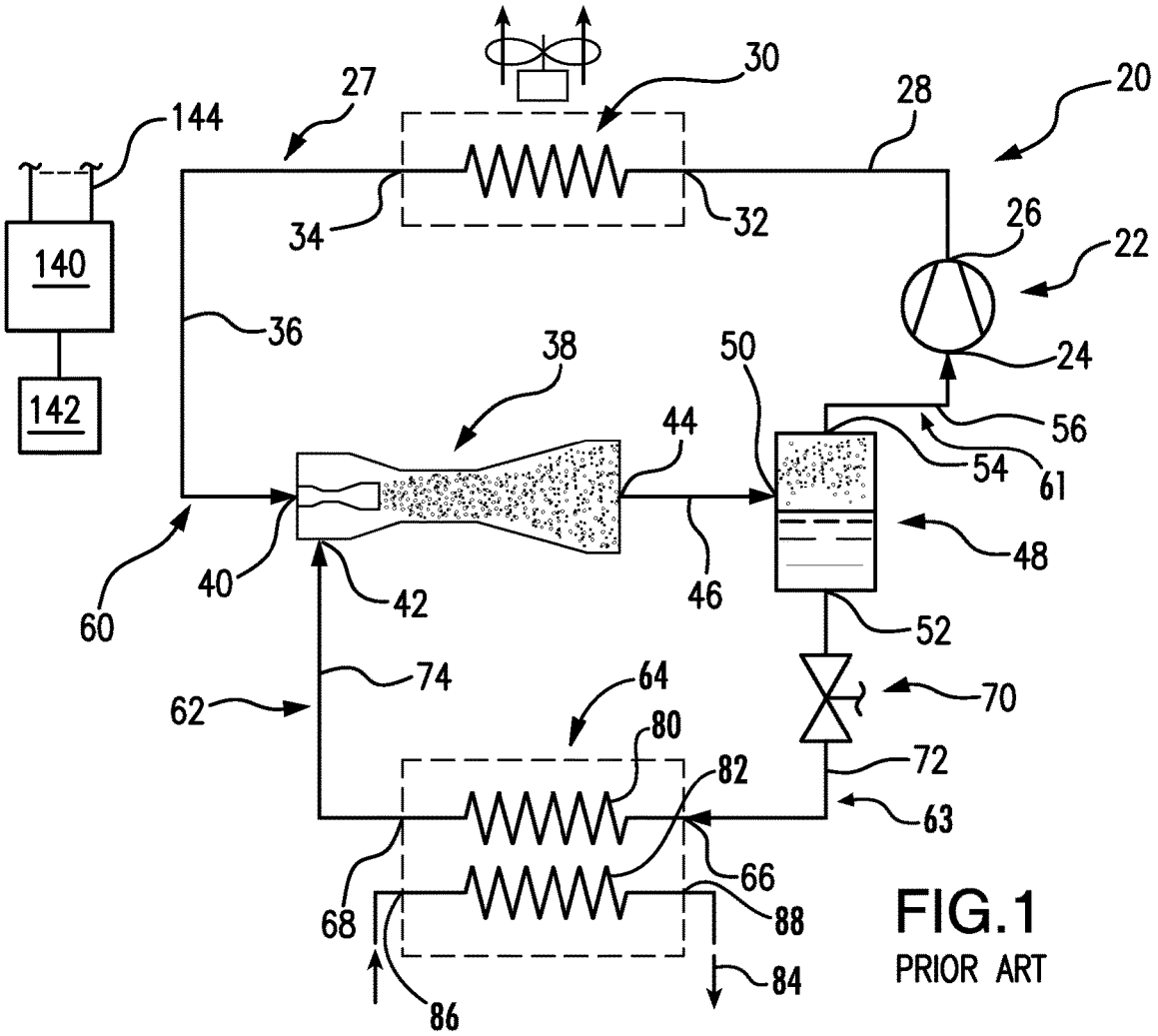
FIG.1 PRIOR ART
FIG. 1 is a schematic view of a prior art ejector refrigeration system.
Figure 2:
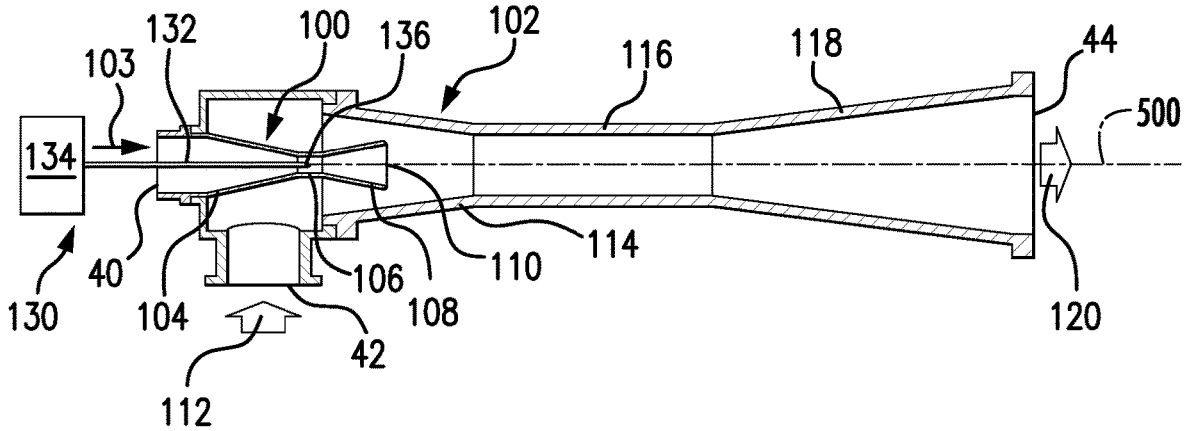
FIG. 2 PRIOR ART
FIG. 2 is an axial sectional view of a prior art ejector.
Figure 3:
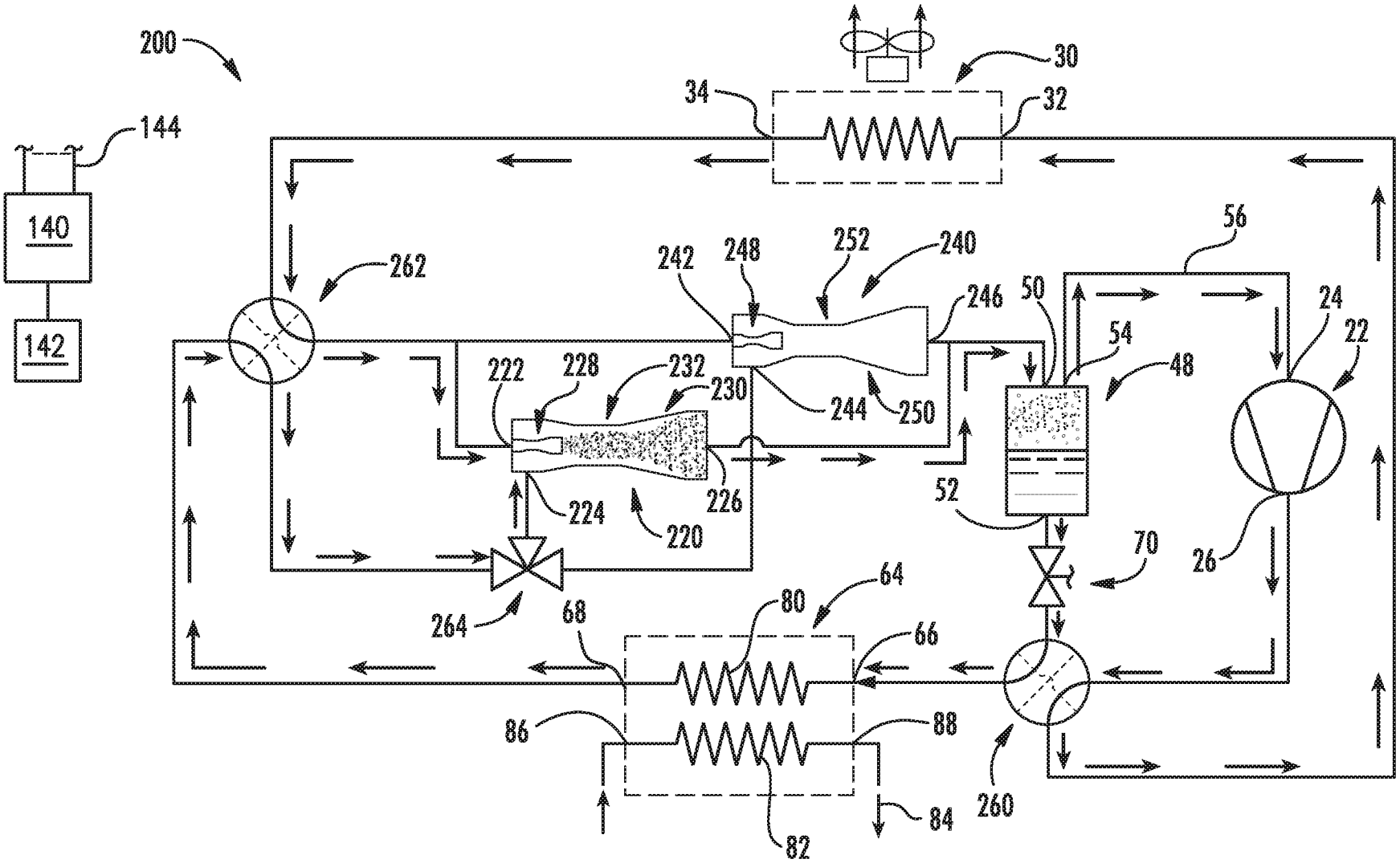
FIG. 3 is a schematic view of a second ejector refrigeration system in a cooling mode.

FIG. 3 shows a modified system 200 wherein various components may be similar to corresponding components mentioned regarding FIGS. 1 and 2. The system 200 is configured to allow at least two normal modes of operation. A first normal mode is a cooling mode similar to the mode described for the system of FIG. 1. A second normal mode is a heating mode wherein the heat absorption and heat rejection functions of the two heat exchangers are reversed. The system 200 may be used for climate control purposes wherein: in the cooling mode chilled water from the heat exchanger 64 is used to cool a building; and in the heating mode heated water from the heat exchanger 64 is used to heat the building. Thus, in this example, the heat exchanger 64 is still a refrigerant-water heat exchanger and the heat exchanger 30 is still a refrigerant-air heat exchanger (e.g., an outdoor heat exchanger transferring heat to or from a fan-forced outdoor air flow).

To provide for switching between these two modes (and any additional modes) relative to the baseline system of FIG. 1, the system 200 may add additional refrigerant lines/conduits and one or more additional refrigerant valves controlling flow along those lines/conduits.

Additionally, the single ejector of FIG. 1 is replaced with two ejectors 220, 240. The ejectors 220 and 240 are respectively associated with the cooling mode and heating mode and optimized in size and any other properties for use in those respective modes. The respective ejectors 220, 240 have respective motive flow or primary flow inlets 222, 242; suction flow or secondary flow inlets 224, 244; outlets 226, 246; motive nozzles 228, 248; diffusers 230, 250; mixers 232, 252; and the like.

The exemplary added valves (260, 262, 264) include a four-way valve 260 linking the compressor discharge line/conduit with a conduit/line of the cooling mode secondary loop between the expansion device 70 and the heat exchanger 64. The exemplary valve 262 is also a four-way valve linking the line/conduit of the cooling mode primary loop between the heat exchanger 30 and ejectors on the one hand and a line/conduit of the secondary loop between the heat exchanger 64 and the ejector 220 secondary flow inlet 224 on the other hand.

A third valve 264 is a three-way valve selectively providing communication between the valve 262 on the one hand and either the first ejector secondary flow inlet or the second ejector secondary flow inlet.

Figure 4:
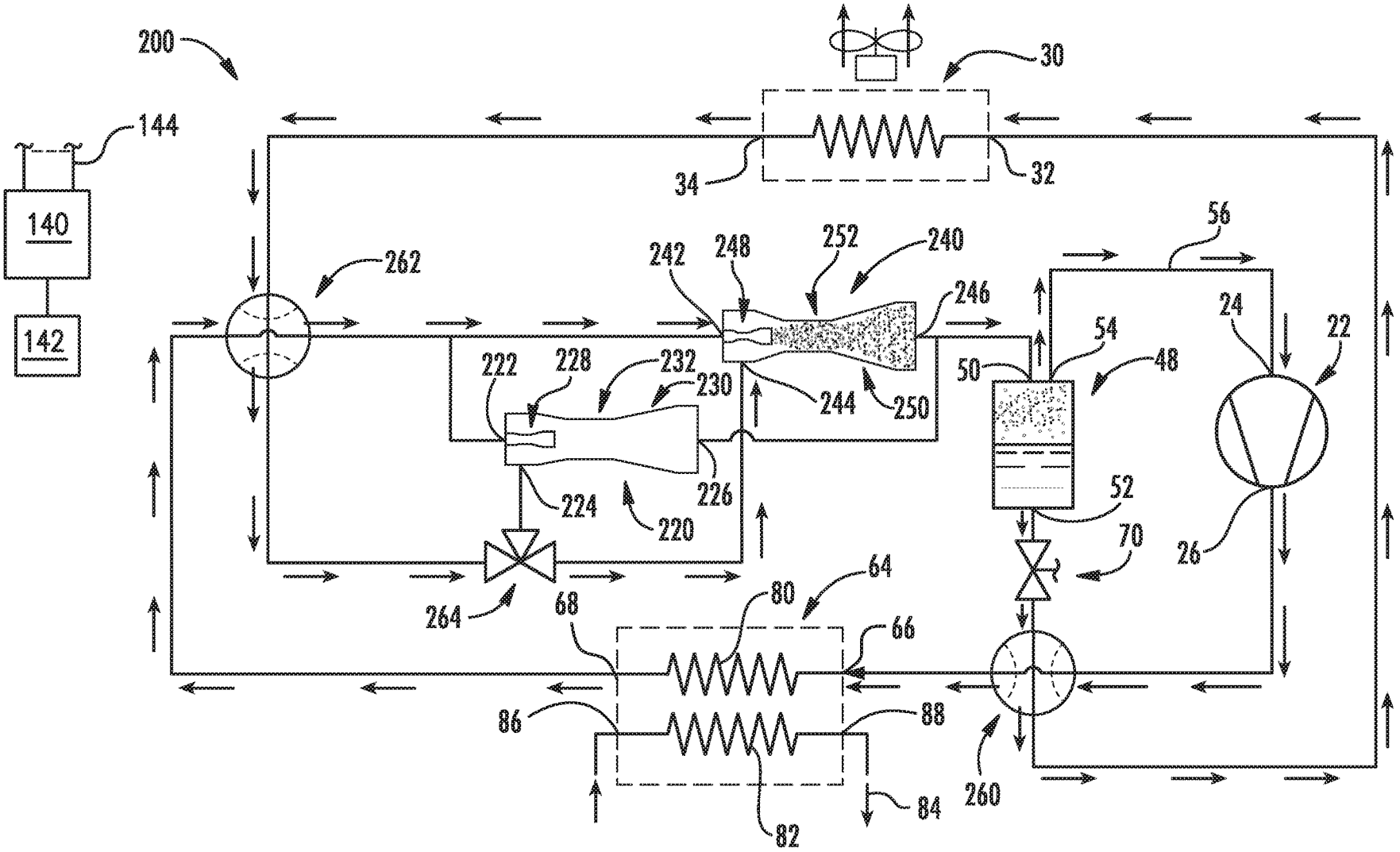
FIG. 4 is a schematic view of the second ejector refrigeration system in a heating mode.

FIG. 3 shows refrigerant flow directions associated with operating in the cooling mode. FIG. 4 shows refrigerant flow directions associated with operating in the heating mode.

The exemplary valves 260 and 262 are illustrated as rotary element valves having a rotary element (e.g., rotated manually or via an electric actuator) having a plurality of passageways which selectively register with associated ports in a housing. The exemplary valves 260 and 262 have two sets of passageways: a first set which registers with the housing ports in the cooling mode and a second set which registers with the housing ports in the heating mode. Alternative valves might involve using the same passageways for both modes but with a different orientation. Yet alternative valves include other configurations such as spool valves and the like.

The three-way valve 264 may also be a simple rotary valve, spool valve, or the like. Due to the simple switching function of this valve, its passageways in its valve element are not shown.

Operation in the cooling mode is as described for FIG. 1. The exemplary ejector 240 is effectively disabled. For example, the valve 264 may pass communication to the secondary flow inlet 224 of the first ejector 220 while blocking communication with the secondary flow inlet 244 of the second ejector 240. Similarly, potential motive flow through the second ejector 240 may be blocked via the needle of the second ejector being in a closed condition.

Subject to the action of the valve 264, the two ejectors are effectively physically in parallel with their primary unit inlets 222, 242 in communication with the valve 262 and their outlets in communication with the separator inlet 50. This allows, via use of the valve 264, either of the ejectors to operate and discharge into the separator 48 so that the same separator 48 is used with both ejectors and the system has only a single separator.

In the FIG. 4 condition, the valves are shifted into the heating mode so that compressor discharge (along a primary flowpath or loop 60') passes through the valve 260 to the heat exchanger 64. At this point, it is seen how the switching of modes may change the nominal function of portions of lines/conduits. In the cooling mode, the entire line/conduit between the compressor discharge port 26 and the first heat exchanger 30 inlet 32 would be regarded as a discharge line. In the heating mode, a proximal portion of that same physical line (i.e., the portion between the compressor discharge port 26 and the valve 260) remains a portion of a discharge line but the remainder of the discharge line is now formed by a segment of what had formerly been the secondary loop 62 between the valve 260 and the heat exchanger 64 inlet 66. The remaining section of the cooling mode discharge line between the valve 260 and the first heat exchanger 30 inlet 32 becomes, in the heating mode, a segment of the secondary loop 62' line. In this capacity, the valve 260 thus passes flow expanded by the expansion device 70 to the first heat exchanger 30 inlet 32.

Thus, it is seen that the valve 260 addresses switching of the roles of the heat exchangers 30 and 64 at their inlet ends. Similarly, the valve 262 addresses the role reversal at outlet ends of the heat exchangers in that it passes outlet flows from the heat exchangers. In the FIG. 3 cooling mode, the valve 262 passes refrigerant from the heat exchanger 30 to the ejectors (more particularly, to the motive/primary flow inlet 222 of the first ejector 220 with the second ejector 240 being shutoff). In the cooling mode, the valve 262 also passes refrigerant from the heat exchanger 64 to the secondary flow inlet 224 via the valve 264 (which simultaneously blocks the secondary flow inlet 244 of the second ejector).

In the FIG. 4 heating mode, the valve 262 passes refrigerant flow from the heat exchanger 64 to the ejectors (e.g., to the motive/primary flow inlet 242 of the second ejector 240 in similar fashion to passing of refrigerant to the first ejector 220 in the cooling mode). In the heating mode, the valve 262 also passes refrigerant from the heat exchanger 30 to the secondary flow inlet 244 via the valve 264.

The two ejectors may have one or more of several asymmetries relative to each other to tailor the ejectors for the particular anticipated conditions of respective cooling mode and heating mode operation. For example, one highly likely difference is the throat area. Specifically, first ejector 220 (the ejector used in the normal cooling mode) may have one or more different size and/or capacity parameters than the second ejector 240 (the ejector used in the normal heating mode). The nature and direction of asymmetry may depend on design conditions (e.g., a system designed for warm summers and warm winters may have a difference relative to one designed for cool summers and cool winters).

For example throat cross-sectional area of one ejector may be greater than that of the other ejector (e.g., at least 5% greater or at least 10% or at least 20% or at least 30% or at least 50%, with exemplary upper ends on ranges being 100% greater or 80% greater or 60% greater). Another possible difference is mixer cross-sectional area. This area may differ by the same amounts as those listed for throat area.

Figure 8:
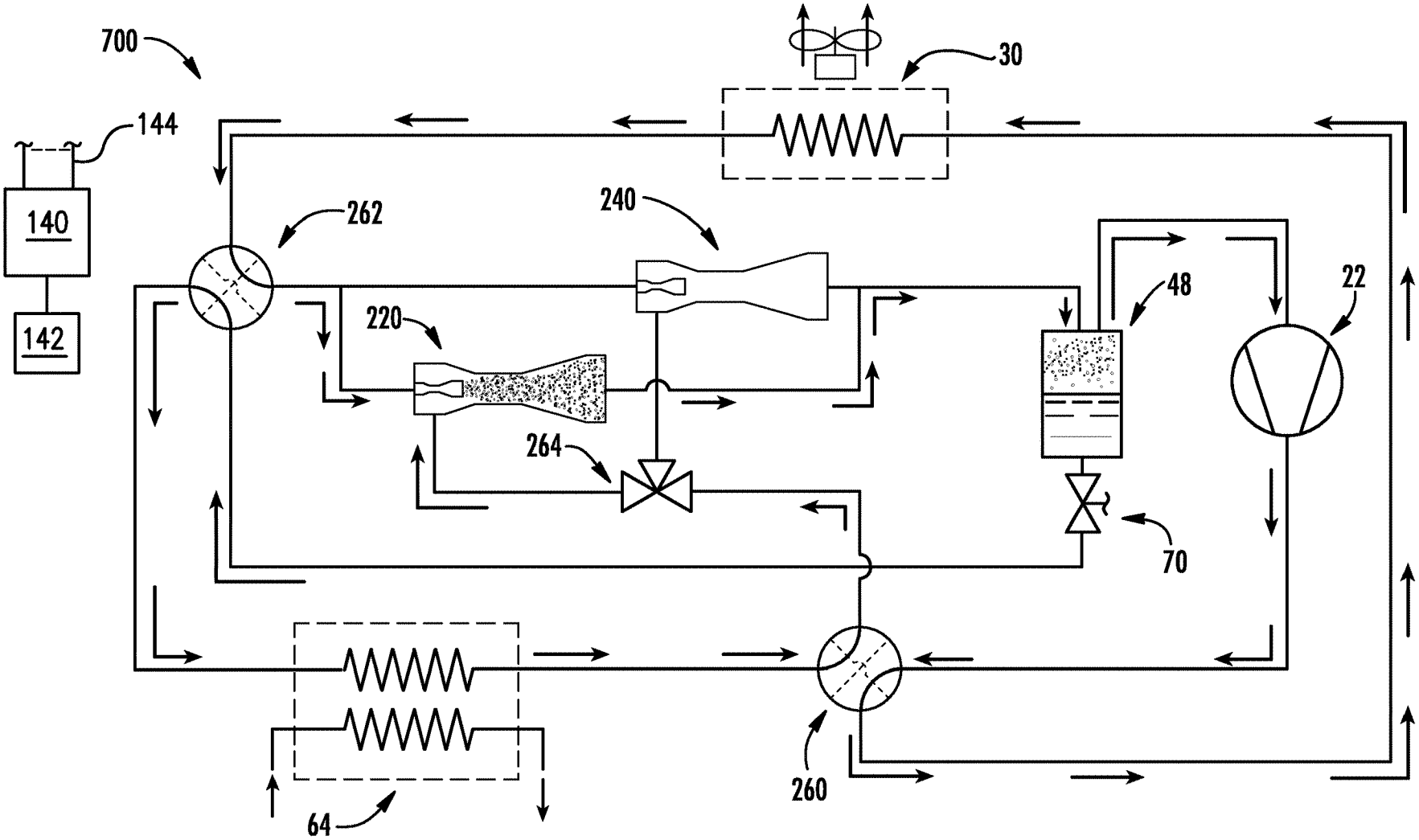
FIG. 8 is a schematic view of a fifth ejector refrigeration system in a cooling mode.

The FIGS. 3 and 4 system further differs, for example, from CN204115293U in that the CN204115293U system passes refrigerant through a given heat exchanger in two different directions in the respective two modes. The FIGS. 3 and 4 system does not reverse refrigerant direction in a given heat exchanger between the two modes. This preserves the relationship between refrigerant flow and the flow of whatever heat transfer medium (e.g., water or air) the refrigerant interacts with in the heat exchangers. This may maintain the relationship in the highest heat transfer condition without additional expenses of altering the flow of the heat transfer medium. For example there may be an essentially pure counterflow relation in the refrigerant-water heat exchanger and a cross-counter relation in the refrigerant-air heat exchanger. However, an alternative FIG. 8 system 700 does reverse refrigerant flow direction in the individual heat exchangers between the cooling mode (shown) and the heating mode (not shown). Transition to heating mode is similar to the transition between FIGS. 3 and 4.

Figure 5:
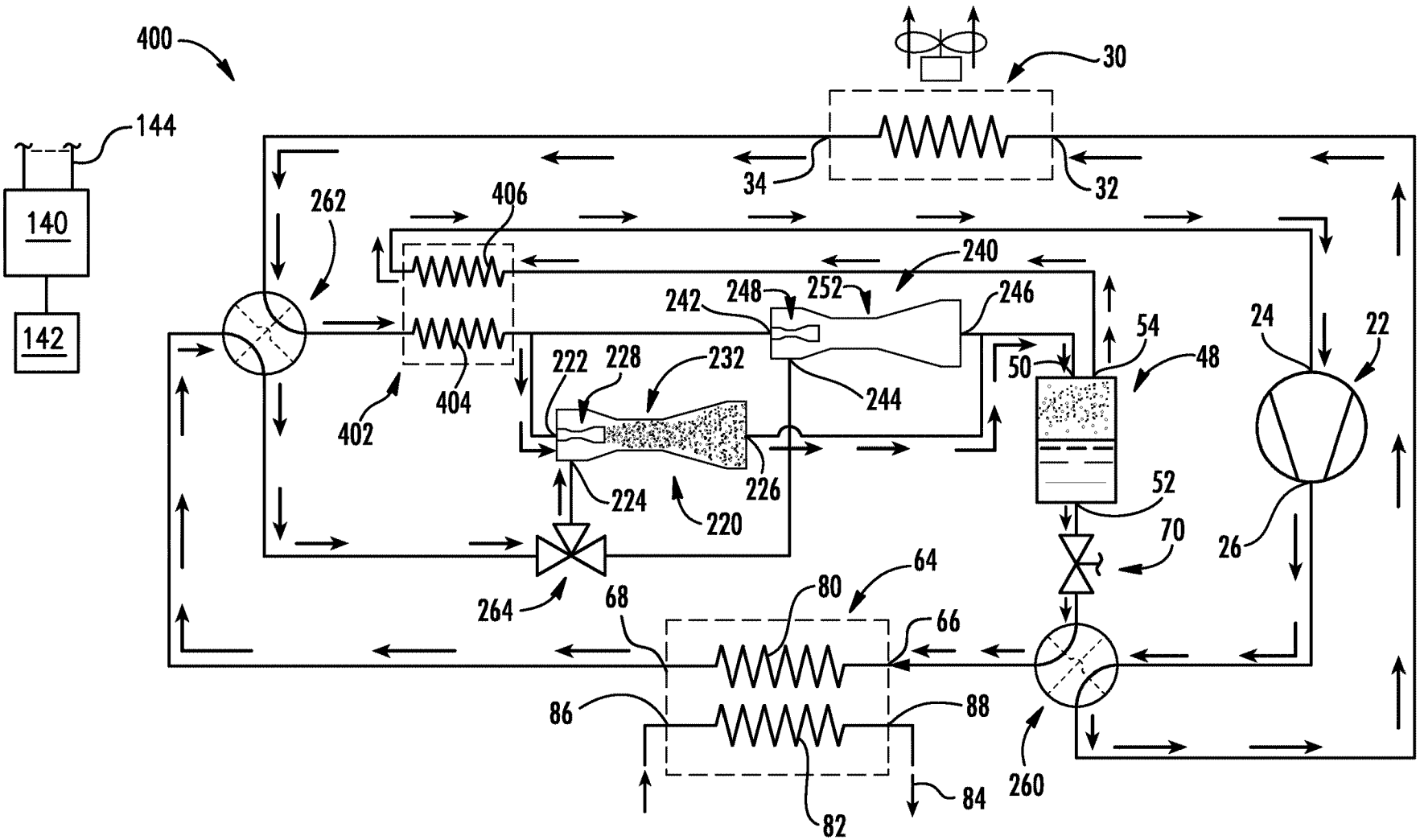
FIG. 5 is a schematic view of a third ejector refrigeration system in a cooling mode.

FIG. 5 shows an alternate system 400 otherwise similar to the system 200 but adding a suction line heat exchanger (SLHX) 402. The SLHX is a refrigerant-refrigerant heat exchanger having a first refrigerant leg 404 in heat exchange relation with a second refrigerant leg 406. The first refrigerant leg is positioned between the valve 262 and the ejector motive/primary flow inlets. The second leg 406 is placed in the suction line between the separator vapor outlet and the compressor suction port or inlet. This positioning allows the suction line heat exchanger to act as a suction line heat exchanger in both the cooling mode and the heating mode. In both such modes, the first leg 404 will be a heat rejection leg and the second leg 406 will be a heat absorption leg. A heating mode of the system 400 reflects a similar switching relative to FIG. 5 as FIG. 4 is to FIG. 3.

FIG. 1 further shows a controller 140. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Figure 6:
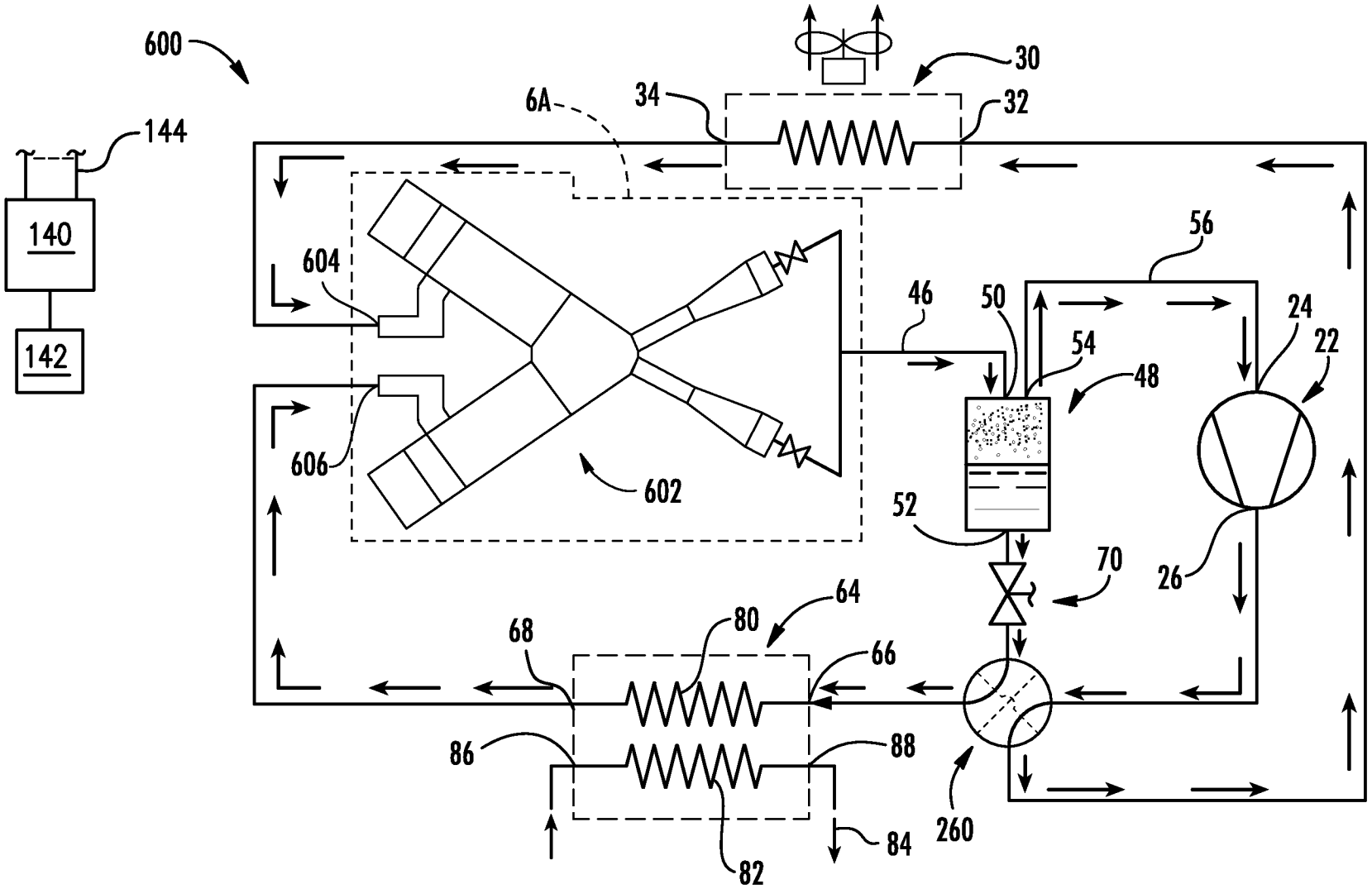
FIG. 6 is a schematic view of a fourth ejector refrigeration system in a cooling mode.

FIG. 6 shows a system 600 comprising a twin ejector assembly 602. The ejector assembly has at least two inlets 604, 606, and at least one outlet. The exemplary ejector has a pair of outlets 608, 610. In the exemplary embodiment, these outlets feed conduits 612, 614 having respective valves 616, 618. The exemplary lines 612, 614 merge to form the line 46 feeding the separator inlet 50. Accordingly, alternatively phrased, the junction or a portion along the line 46 may be treated as a single outlet in this embodiment.

As is discussed further below the exemplary ejector assembly 602 has at least two modes of operation. In one or more first modes, the inlet 604 is a motive or primary flow inlet and the inlet 606 is a suction or secondary flow inlet. In one or more second modes, the functions are reversed so that the inlet 604 is the suction or secondary flow inlet and the inlet 606 is the motive or primary flow inlet.

Otherwise similar to the FIG. 3 embodiment, the respective ports 604 and 606 are coupled to/fed by the respective lines from the heat exchangers 30 and 64. Thus this illustrated embodiment eliminates the valves 262 and 264, thus saving their costs.

Figure 6A:
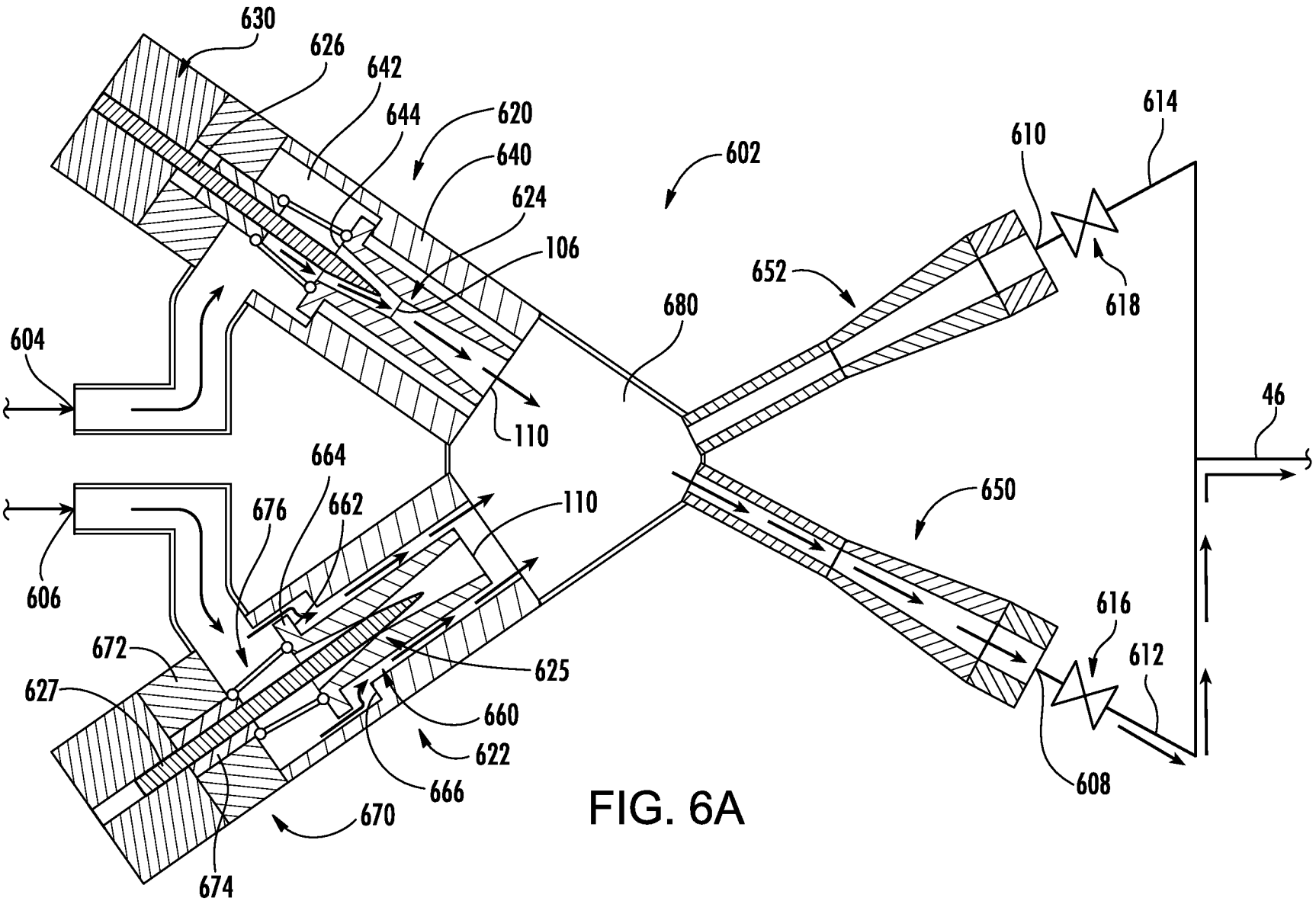
FIG. 6A is an enlarged view of a twin ejector assembly of the system of FIG. 6, taken at view 6A of FIG. 6.

The exemplary ports 604, 606 are coupled to respective nozzle units 620, 622. The exemplary nozzle units are nozzle/needle units having a nozzle 624, 625 and a needle 626, 627. The nozzle may be configured as the motive nozzle discussed above having similar features which are not separately discussed. FIG. 6A shows a needle actuator 630 which may be similar to needle actuators in the prior art or as otherwise may be developed (e.g., electromagnet/solenoid type actuators, stepper actuators, and the like).

Each unit 620, 622 comprises a body 640 holding the motive nozzle 624, 625. FIG. 6A shows, for the unit 620, an inlet flow passing through the inlet 604 into a chamber 642 surrounding the needle, and then through an inlet 644 of the motive nozzle 624. FIG. 6A further shows each of the units 620, 622 associated with a respective mixer/diffuser unit 650, 652 which may have similar features to mixers and diffusers discussed above or otherwise developed.

FIG. 6A shows one condition for the motive nozzle of the first unit 620 but a different second condition for the motive nozzle of the unit 622. This exemplary second condition is a bypass condition wherein the central passageway of the motive nozzle is bypassed along a flowpath 660. An exemplary flowpath 660 is a generally annular flowpath surrounding the motive nozzle 624, 625. The exemplary bypass is opened up via a motion of the motive nozzle. An exemplary motion is an axial retraction. An exemplary retraction disengages the underside 662 of a flange 664 of the motive nozzle from a surface 666 of an internal shoulder of the housing 640 to open up the flow along the path 660. A closing motion would involve the opposite direction.

The opening of the flow along the path 660 may be accompanied by a closing of flow along the central passageway of the subject motive nozzle (e.g., via a sealing engagement of the needle with the throat).

Exemplary motive nozzle actuation may be via solenoid, stepper motor, or the like. An exemplary actuator 670 may have a fixed portion 672 (e.g., solenoid coil unit) and a moving portion 674 (e.g., solenoid plunger). The moving portion may be coupled to the associated motive nozzle by a linkage 676 (e.g., a circumferential array of arms having first ends mounted at a downstream end of the plunger and second ends mounted to the flange to define a cage). The cross-sectional area along the flowpath 660 is substantially greater than the minimum cross-sectional area along the flowpath through the motive nozzle (e.g., the throat area). This can allow the open flow passage 660 of one of the units 620, 622 to carry a suction/secondary flow driven by a motive flow passed through the central passageway of the other of the units 620, 622. To do this, the two units 620, 622 feed a plenum 680 having respective inlets receiving flows from the units 620, 622 and outlet ports positioned to feed the mixer(s) and diffuser(s). In the exemplary implementation, each mixer/diffuser unit is approximately aligned with its associated nozzle unit 620, 622. When a given nozzle unit is utilized to pass motive flow, the associated mixer/diffuser 650, 652 may be open (e.g., via its valve 616, 618) while the other mixer/diffuser unit is closed.

The crossing orientation of the nozzle units and mixer/diffuser units may facilitate flow mixing (e.g., as opposed to having a parallel orientation). Based upon anticipated flow conditions, the angles may be optimized considering the complicated momentum mixing during the supersonic two phase flow process. Exemplary angles between axes of the two nozzle units may be between 0° and 90° or 30° and 90° or 40° and 70°. Similarly, exemplary angles between axes of the two mixer/diffuser units may be between 0° and 90° or 30° and 90° or 40° and 70°.

Figure 7:
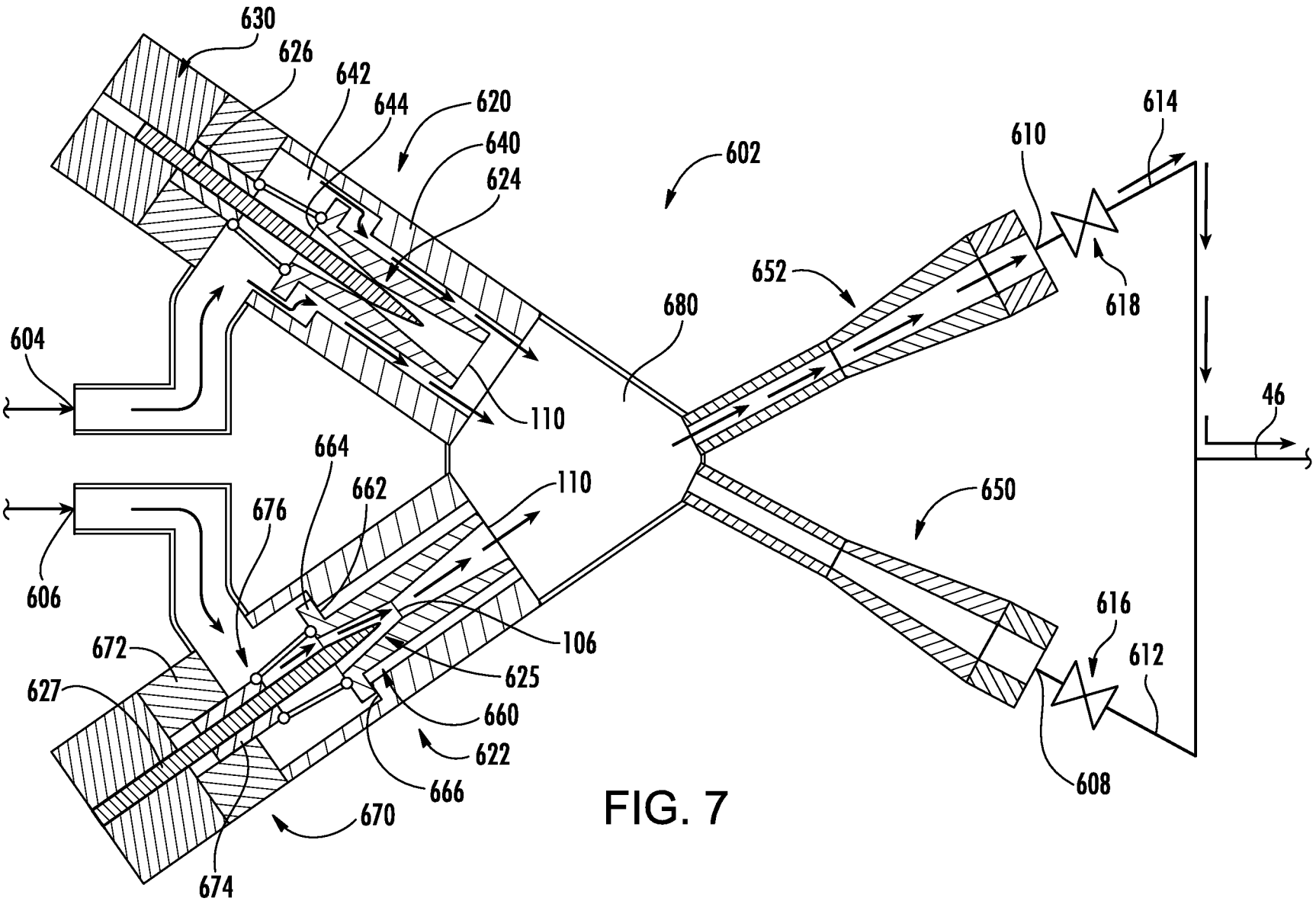
FIG. 7 is a schematic view of a twin ejector assembly of FIG. 6 in a heating mode.

Switching between the heating mode and cooling mode may involve a similar actuation of valves 260 and 262 as is used in either of the other embodiments. The valve 264 is eliminated or avoided. FIG. 7 shows a condition of the ejector assembly 602 in the heating mode wherein the motive nozzle state/position and the needle state are reversed relative to their FIG. 6A counterparts.

In the exemplary system 600, switching between the heating mode and cooling mode involves the actuation of the nozzle actuators 670 of the two units, the needle actuators 630 of the two units, and the four-way valve 260. For example, in the cooling mode, the flow passage through the four-way valve 260 is shown in FIG. 6 and the flow passage through the twin ejector is shown in FIG. 6A; in the heating mode, the flow passage through the four-way valve 260 is similar to that in FIG. 4 and the flow passage through the twin ejector assembly is as shown in FIG. 7. In this way, both the second four-way valve 262 and three-way valve 264 are eliminated or avoided.

Figure 9:
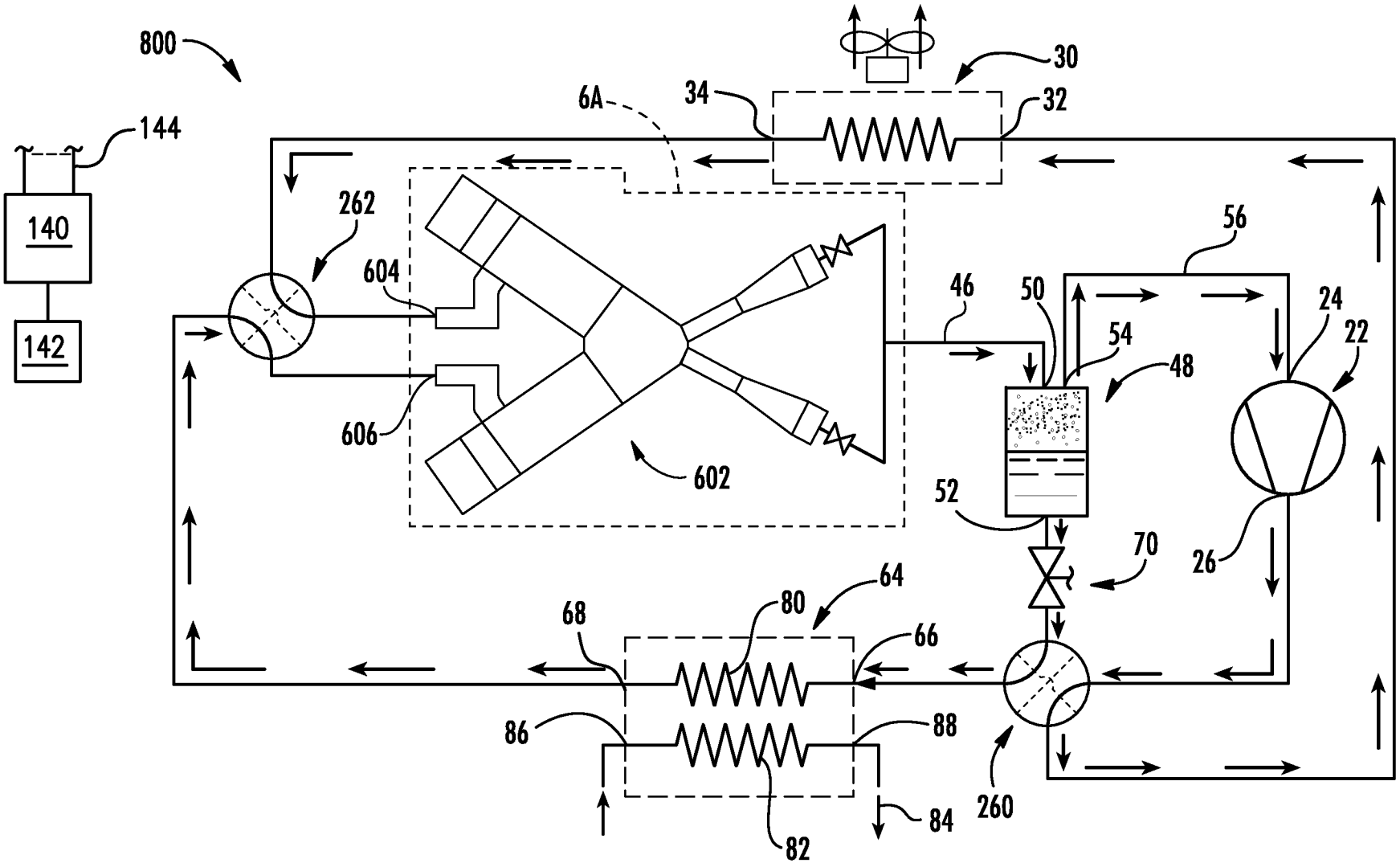
FIG. 9 is a schematic view of a sixth ejector refrigeration system in a cooling mode.

In the exemplary system 600, the motive nozzle units and the mixer/diffuser units may have similar asymmetries to those of the ejectors of the FIGS. 3 and 5 embodiments. Additional variations may relate to the relationships between the nozzle units 620, 622 and the mixer/diffuser units 650, 652. A further variation on the FIG. 6 system is the FIG. 9 system 800. This preserves the valves of the FIG. 3 system 200 to allow greater flexibility in operation. This, for example, allows the roles of the nozzle units to be switched within a given mode.

Figure 10:
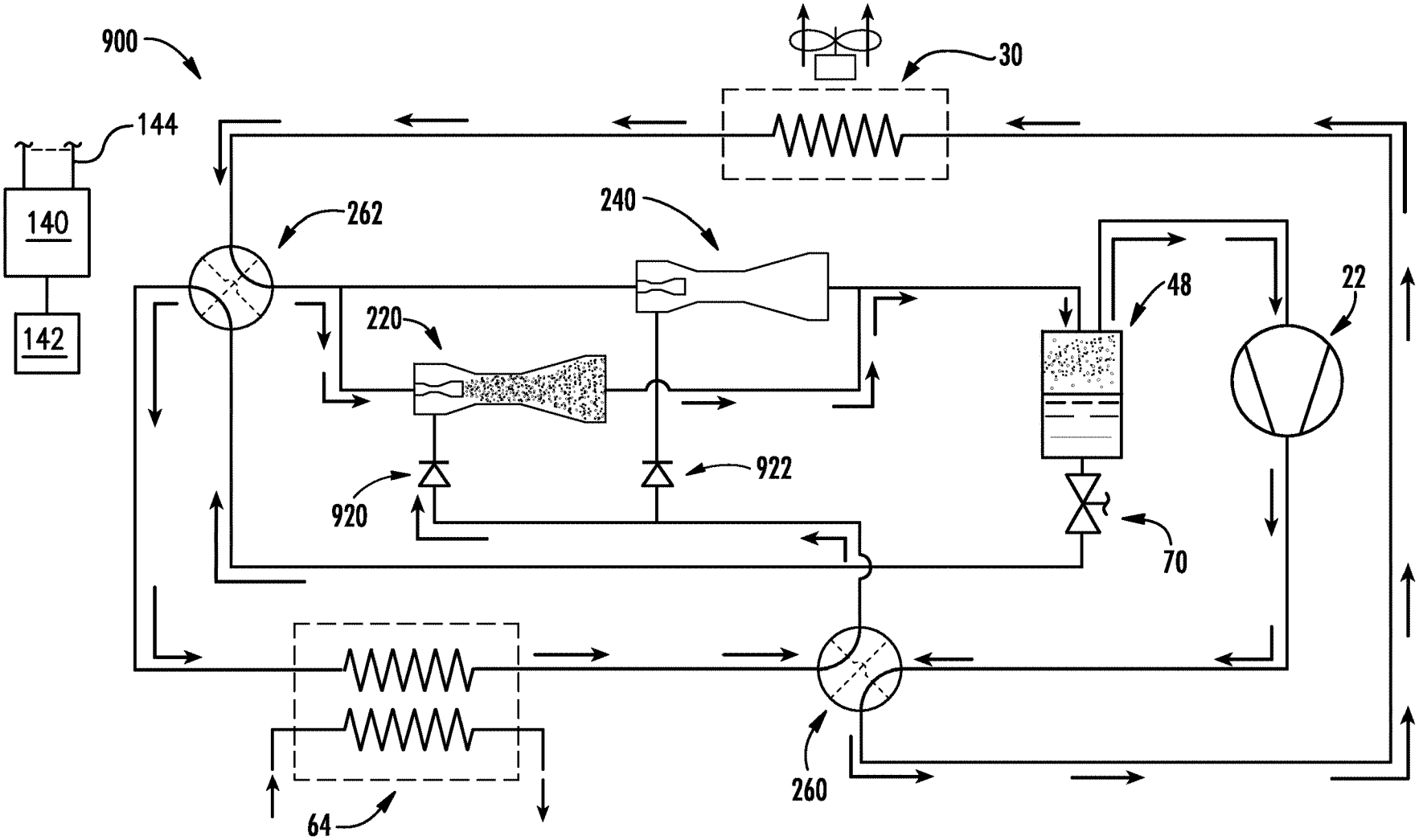
FIG. 10 is a schematic view of a seventh ejector refrigeration system in a cooling mode.
Figure 11:
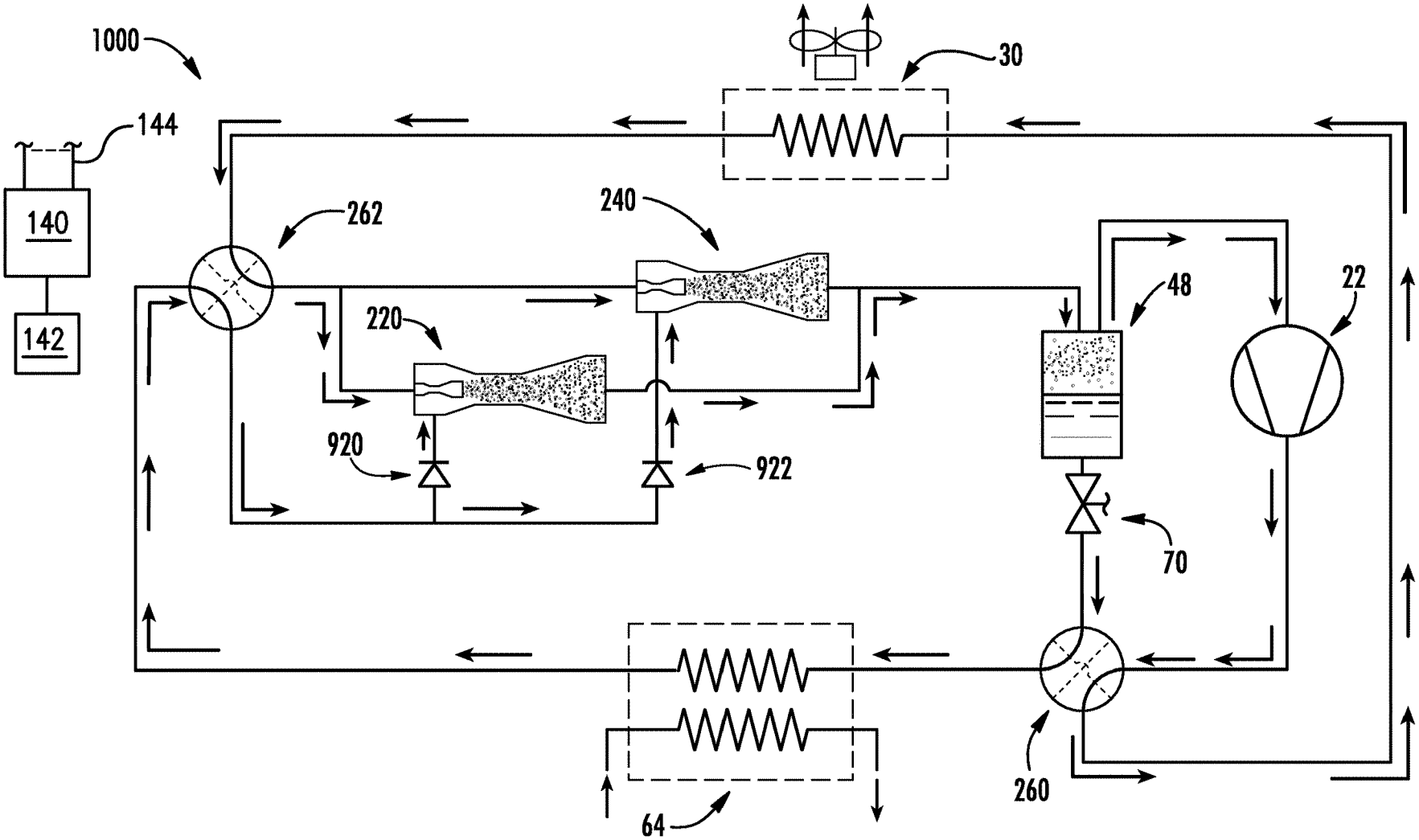
FIG. 11 is a schematic view of an eighth ejector refrigeration system in a cooling mode.

FIGS. 10 and 11 show respective systems 900 and 1000 that omit the three-way valve. Flow through individual compressors is controlled by valves specific to those compressors. For example, the FIG. 2 needle valve may be closed to block motive/primary flow. Suction/secondary flow may be blocked directly via valves in the lines feeding the secondary flow inlets or indirectly by valves at the ejector outlets (in combination with needle closing). The illustrated examples have one-way valves (check valves) 920, 922 positioned to block reverse flow from the secondary flow inlets.

Either or both ejectors may be used in each of the cooling and heating modes. The particular ejector or combination of ejectors used in a given mode may be selected to best correspond to the requirements of such mode. FIG. 10 shows the system in a cooling mode with only the first ejector 220 active. The four-way valve 260 is positioned between the outlet of the heat exchanger 64 and the inlets of the ejectors. The needle of the second ejector 240 is closed and the check valve 922 prevents reverse flow from the outlet of the second ejector back through the secondary flow inlet. Alternatively, the second ejector could be active or both ejectors could be active. The illustrated refrigerant lines and valves provide for a reversed refrigerant flow direction through the heat exchangers in heating mode as discussed previously.

In contrast to FIG. 10, the system 1000 of FIG. 11 preserves refrigerant flow direction through the heat exchangers in heating mode as discussed previously by positioning the four-way valve 260 between the expansion valve 70 outlet and the inlets of the heat exchanger 64. For purposes of illustration, both ejectors are shown active in the illustrated cooling mode although either could be individually active.

The systems may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A vapor compression system (200; 400; 700; 800; 900; 1000) comprises a plurality of valves (260, 262, 264; 260) controllable to define:

a first mode flowpath sequentially through:
- a compressor (22);
- a first heat exchanger (30);
- a first motive nozzle (228) of a first ejector; and
- a separator (48), and then branching into:
  - a first branch returning to the compressor; and
  - a second branch passing through an expansion device (70) device and a second heat exchanger (64) to the rejoin the flowpath between the first heat exchanger and the separator; and a second mode flowpath sequentially through:
- the compressor;
- the second heat exchanger;
- a second nozzle (248) of a second ejector; and
- the separator, and then branching into:
  - a first branch returning to the compressor; and
  - a second branch passing through the expansion device and first heat exchanger to the rejoin the flowpath between the first heat exchanger and the separator, wherein at least one of: the plurality of valves are controllable to; or one or more check valves (920, 922) are positioned to:

in the first mode block a reverse flow through the second ejector; and in the second mode block a reverse flow through the first ejector.

2. A vapor compression system (200; 400; 700; 800; 900; 1000) comprising:

a compressor (22);

a first heat exchanger (30);

a second heat exchanger (64);

a first ejector (220) having a first motive nozzle;

a second ejector (222) having a second motive nozzle;

a separator (48) having:
- an inlet (50);
- a liquid outlet (52); and
- a vapor outlet (54);

an expansion device (70); and a plurality of conduits, wherein the system further comprises a plurality of valves (260, 262, 264; 260) controllable to define:

a first mode flowpath sequentially through:
- the compressor;
- the first heat exchanger;
- the first motive nozzle (228); and
- the separator, and then branching into:
  - a first branch returning to the compressor; and
  - a second branch passing through the expansion device and second heat exchanger to the rejoin the flowpath between the first heat exchanger and the separator; and a second mode flowpath sequentially through:
- the compressor;
- the second heat exchanger;
- the second motive nozzle (248); and the separator, and then branching into:
a first branch returning to the compressor; and
a second branch passing through the expansion device and first heat exchanger to the rejoin the flowpath between the first heat exchanger and the separator, wherein at least one of: the plurality of valves are controllable to; or one or more check valves (920, 922) are positioned to:
in the first mode block a reverse flow through the second ejector; and
in the second mode block a reverse flow through the first ejector.

3. The vapor compression system of claim 2 wherein:
one or more check valves (920, 922) are positioned to block reverse flow through at least one of the first ejector and second ejector.

4. The vapor compression system of claim 2 wherein:
the first heat exchanger is a refrigerant-air heat exchanger and the second heat exchanger is a refrigerant-water heat exchanger.

5. The vapor compression system of claim 2 wherein the plurality of valves comprises:
a first four way valve (260); and
a second four way valve (262).

6. A vapor compression system (200; 400; 700; 900; 1000) comprising:
a compressor (22);
a first heat exchanger (30);
a second heat exchanger (64);
a first ejector (220) comprising:
a motive flow inlet (222);
a secondary flow inlet (224); and
an outlet (226); and
a separator (48) having:
an inlet (50);
a liquid outlet (52); and
a vapor outlet (54);
an expansion device (70); and
a plurality of conduits, wherein the system further comprises:
a second ejector (240) comprising:
a motive flow inlet (242);
a secondary flow inlet (244); and
an outlet (246);
a plurality of valves (260, 262, 264) controllable to define:
a first mode flowpath sequentially through:
the compressor;
the first heat exchanger;
the first ejector from the first ejector motive flow inlet through the first ejector outlet; and
the separator, and then branching into:
a first branch returning to the compressor; and
a second branch passing through the expansion device and second heat exchanger to the first ejector secondary flow inlet,
a second mode flowpath sequentially through:
the compressor;
the second heat exchanger;
the second ejector from the second ejector motive flow inlet through the second ejector outlet; and
the separator, and then branching into:
a first branch returning to the compressor; and
a second branch passing through the expansion device and first heat exchanger to the second ejector secondary flow inlet, wherein at least one of: the plurality of valves are controllable to; or one or more check valves (920, 922) are positioned to:
in the first mode block a reverse flow through the second ejector secondary flow inlet; and
in the second mode block a reverse flow through the first ejector secondary flow inlet.

7. The vapor compression system of claim 6 wherein:
the first ejector and the second ejector are of different sizes.

8. The vapor compression system of claim 7 wherein:
the first ejector has a greater throat cross-sectional area than the second ejector.

9. The vapor compression system of claim 7 wherein:
the first ejector has a greater mixer cross-sectional area than the second ejector.

* * * * *